US005997377A

United States Patent [19]

Sagara et al.

[11] Patent Number: 5,997,377

[45] Date of Patent: Dec. 7, 1999

[54] PROCESS FOR THE PRODUCTION OF SPACERED SUBSTRATE FOR USE IN SELF-EMITTING DISPLAY

[75] Inventors: Hiroji Sagara; Yoichi Hachitani, both of Tokyo, Japan

[73] Assignee: Hoya Corporation, Japan

[21] Appl. No.: 08/751,689

[22] Filed: Nov. 18, 1996

[30] Foreign Application Priority Data

Nov. 17, 1995 [JP] Japan ..... 7-300026

[51] Int. Cl.[6] ..... H01J 9/24

[52] U.S. Cl. ..... 445/24

[58] Field of Search ..... 445/24; 313/309

[56] References Cited

U.S. PATENT DOCUMENTS 5,503,582 4/1996 Cathey, Jr. et al. ..... 445/24

5,705,079 1/1998 Elledge ..... 445/24 UX 5,763,139 6/1998 Matsunaga et al. ..... 445/24

*Primary Examiner*—Kenneth J. Ramsey

*Attorney, Agent, or Firm*—Nixon & Vanderhye

[57] ABSTRACT

The process for the production of a spacered substrate for use in a self-emitting display, provided by the present invention, comprises the steps of exposing a photosensitive glass to light while masking a portion to form a spacer on a surface of the photosensitive glass, to form a latent image corresponding to an exposed portion, crystallizing the exposed portion having the latent image, removing a crystallized exposed portion by an etching treatment, and thereby forming a spacer of non-exposed photosensitive glass on a glass substrate. According to the present invention, there is provided a spacered substrate for use in a self-emitting display, in which the spacer has high accuracy and high heat resistance and the roughening of the substrate surface is not easily caused.

10 Claims, 7 Drawing Sheets

PROCESS FOR THE PRODUCTION OF SPACERED SUBSTRATE FOR USE IN SELF-EMITTING DISPLAY

TECHNICAL FIELD

The present invention relates to a process for the production of a spacered substrate for use in a self-emitting display, more specifically, to a process for effectively producing a spacered substrate suitable for a field emission display in particular.

PRIOR ART

In recent years, self-emitting displays such as a flat CRT, a plasma display, an elctroluminescent display, a fluorescent display tube and a field emission display have been being energetically developed. These self-emitting displays attract attention as a display in a coming age for reasons that a wide viewing angle is provided, that no power-consumptive back-light is required and that a high brightness is attained. Above all, a field emission display shows high light emission efficiency and is the most promising display. FIG. 1 shows the basic structure of a field emission display. In a back panel 1 of this display, a cathode (ITO) 2, an emitter 3, an insulating layer 4 and a gate 5 are formed, and in a front panel 6 thereof, an anode 7 and a phosphor 8 are formed. A space between the emitter 3 and the phosphor 8 is kept in vacuum, and a spacer is required so that the panels 1 and 6 can withstand the vacuum and ambient atmospheric pressure. A liquid crystal display generally uses a spacer of small-diametered glass beads having a diameter of about 5 $\mu$m. In a field emission display, however, the front panel 6 and the back panel 1 are spaced from each other at a distance of about several hundred $\mu$m, and it is therefore required to use glass beads having a diameter of several hundred $\mu$m. When glass beads having such large diameters are used, some glass beads penetrate pixels and consequently deteriorate an image quality. There is therefore required a spacer 9 having the form of a pillar.

Some methods have been proposed for forming spacers of the above kind. JP-A-4-58438 discloses a method of forming a spacer, in which a glass paste is applied to a substrate by a thick film printing method and then the glass paste is processed by a sand blast method using a resist pattern as a mask.

JP-A-6-119876 discloses a method of forming a spacer, in which an insulating material (glass) in the form of a sheet is attached onto a substrate and the insulating material is sand-blast-processed using a resist pattern as a mask.

Further, JPA-5-325843 discloses a method of forming a spacer, in which a glass paste is applied to a substrate to form multi-layers by a screen printing method.

Further, JP-A-6-60804 discloses a method of forming a spacer, in which a patterned reflection layer is deposited on a spacer-forming material, those portions of the spacer-forming material on which the reflection pattern is not deposited are selectively melted by laser to retain only those portions of the spacer-forming material on which the reflection pattern is deposited.

However, in the methods using sand blast, disclosed in JP-A-4-58438 and JP-A-6-119876, it is difficult to fabricate a spacer in good accuracy. In the sand blast method, moreover, not only it is difficult to form an acute angle, but also the substrate surface may be roughened.

In the multi-layer printing method disclosed in JP-A-5-325843, a long time is taken due to numerous steps, and further, a spacer is liable to be deformed due to an error in screen positioning and a non-uniformity in thickness.

Further, the laser melting method disclosed in JP-A-6-60804 has the following defects. It is difficult to control uniform melting in the selective melting of the spacer-forming material so that excessive melting may roughen the substrate surface on which the spacer-forming material is provided. A polyimde or silicon nitride is used as a spacer-forming material, while polyimide is poor in heat resistance. Silicon nitride is generally used for forming a film by sputtering, and the film formation takes time and requires an expensive laser apparatus.

It is an object of the present invention to provide a process for the production of a spacered substrate for use in a self-emitting display, a field emission display in particular, in which (a) the obtained spacer has high accuracy and high heat resistance, (b) the roughening of the substrate surface is not easily caused, and (c) the production procedures are simple.

DISCLOSURE OF THE INVENTION

The object of the present invention is achieved by a process for the production of a spacered substrate for use in a self-emitting display, which comprises the steps of exposing a photosensitive glass to light while masking a portion to form a spacer on a surface of the photosensitive glass to form a latent image corresponding to an exposed portion, crystallizing the exposed portion having the latent image, removing a crystallized exposed portion by an etching treatment, and thereby forming a spacer of non-exposed photosensitive glass on a glass substrate.

PREFERRED EMBODIMENTS

Figure 1:
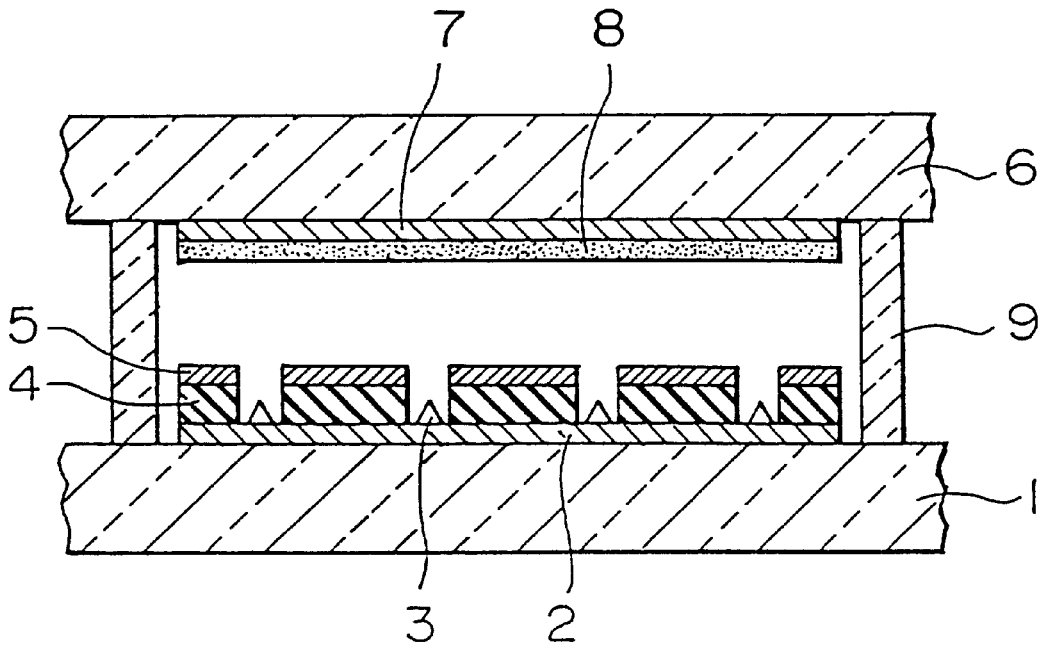
FIG. 1 is a schematic cross-sectional view of a field emission display.

The process for the production of a spacered substrate for use in a self-emitting display, provided by the present invention, is a novel process which is totally different from the above conventional methods, since a non-exposed non-crystallized portion remaining after an etching treatment is used to form a spacer while paying attention to the fact that the etching rate of a crystallized portion formed by the selective exposure and heat treatment of a photosensitive glass is remarkably higher than the etching rate of the non-exposed non-crystallized portion. The process of the present invention is advantageous in that (a) the obtained spacer has high accuracy and high heat resistance, that (b) the roughening of the substrate surface is not easily caused, and that (c) the production process is simple so that the production cost is inexpensive.

The process for the production of a spacered substrate for use in a self-emitting display, provided by the present invention, will be specifically explained hereinafter.

The photosensitive glass used in the process of the present invention can be any photosensitive glass so long as it contains a photosensitive portion, forms a latent image by exposure thereof to light and deposits a crystal in an exposed portion alone, the crystal showing an etching rate greatly different from that of glass in heat treatment. For example, it is particularly preferred to use a photosensitive glass containing 55 to 85% of $SiO_2$, 2 to 20% of $Al_2O_3$ and 5 to 15% of $Li_2O$ in which $SiO_2+Al_2O_3+Li_2O>85\%$ as fundamental components, containing at least one of 0.001 to 0.05% of Au, 0.001 to 0.5% of Ag and 0.001 to 1% of $Cu_2O$ as a photosensitive component and containing 0.001 to 0.2% of $CeO_2$ as a photosensitizer, all percentages being based on weight.

In the process of the present invention, first, the photosensitive glass is exposed to light while masking a portion to form a spacer on the surface of the photosensitive glass to form a latent image corresponding to an exposed portion.

The form of the spacer in the present invention is not specially limited so long as it can perform the function as a spacer, and it includes various forms. For example, the space has the form of any one of a pillar, a partition wall, a lattice and a honeycomb. With an increase in the supporting area of the spacer, the spacer increases in strength.

The mask used for the above masking can be any mask so long as it has a predetermined pattern corresponding to a form crossing the surface of the spacer and intimately contacts to the photosensitive glass so that the photosensitive glass can be selectively exposed to light. For example, it is preferred to use a mask prepared by forming a pattern of a chromium film on a translucent glass.

The above mask is intimately attached to the above photosensitive glass, and the photosensitive glass is exposed to light while masking a portion to form a spacer on the photosensitive glass, whereby a core formed of particles of a photosensitive metal (Ag, Au, Cu, or the like) is formed, and a latent image is formed, in an exposed portion. As means for the exposure, for example, it is preferred to carry out the exposure to ultraviolet light for a predetermined period of time (e.g., 5 seconds to 5 minutes) with a mercury lamp or a mercury-xenon lamp.

Further, a mask can be prepared by adding an opacifier (light shielding agent) such as cerium oxide or titanium oxide to a low melting point glass used as an adhesive for bonding the photosensitive glass and a glass substrate to be described later, to prepare an opacified low melting point glass paste, and screen-printing the glass paste on a portion where a spacer is to be formed. In this case, the opacified low melting point glass is preferred since it can be also used as an adhesive for the subsequent bonding of the photosensitive glass and the glass substrate to each other.

In the process of the present invention, an exposed portion having a latent image is crystallized. This crystallization treatment is carried out by heat treatment of the latent-image-formed photosensitive glass at a temperature equivalent to, or higher than, the glass transition point. The exposed portion having the latent image is crystallized by the heat treatment for reasons that particles of the photosensitive metal present in the above exposed portion act as cores to grow, for example, a crystal of lithiummetasilicate ($Li_2 \cdot SiO_2$). This crystal has the property of being easily dissolved in an acid, so that the subsequent etching treatment can be smoothly carried out.

In the present invention, then, the crystallized exposed portion is removed by etching treatment, and a non-exposed portion is retained, so that one spacer member or at least two spacer members of the non-exposed photosensitive glass are formed, whereby the intended spacered substrate for use in a self-emitting display is obtained.

The above etching treatment is carried out, for example, by immersing the photosensitive glass having the crystal-deposited exposed portion in a hydrofluoric acid-containing etchant. For example, when the above photosensitive glass is immersed in diluted hydrofluoric acid having a concentration of about 2 to 6%, the lithium metasilicate crystallized portion is dissolved at a rate about 20 to 70 times the rate of the non-crystallized glass portion. Therefore, the exposed crystallized portion is selectively removed by dissolving, whereby the spacer formed of the non-exposed photosensitive glass can be obtained. As a hydrofluoric acid-containing etchant, other hydrofluoric acid-containing etchant such as buffered hydrofluoric acid may be used.

In the process of the present invention, the spacer of the non-exposed photosensitive glass is formed on a glass substrate.

In the process of the present invention, depending upon the form of the spacer, the method of forming the above-formed spacer on a glass substrate is properly selected, for example, from (i) a method in which a glass substrate is preliminarily bonded to the photosensitive glass on which a latent image is to be formed by exposure, i.e., the photosensitive glass as a starting materiel, (ii) a method in which a latent image is formed by exposure, and then the glass substrate is bonded to the photosensitive glass at a step prior to the etching treatment, or (iii) a method in which the photosensitive glass (spacer) prepared by forming a latent image by exposure and then carrying out the etching treatment is bonded to a glass substrate. For example, it is advantageous to employ the above method (i) or (ii) for producing a spacer having the form of a pillar or a partition wall. For producing a spacer having the form of a lattice or a honeycomb, any method may be used, while the method (iii) is suitable in particular.

In the above methods (i) and (ii), the glass substrate to be bonded to the photosensitive glass may be any glass substrate so long as it has excellent chemical durability (durability against an etching solution in particular) and undergoes no crystallization under the heat treatment for bonding it to the photosensitive glass, while preferred is a glass substrate which is consistent with the above photosensitive glass in heat expansion characteristic. For example, in the above bonding method (ii), the above photosensitive glass which is not exposed to light may be used as a glass substrate. In the above bonding methods (i) and (ii), there may be used, as a glass substrate, a non-photosensitive glass which has the same composition as that of the photosensitive glass except that it contains neither a photosensitive component (Ag, Au, Cu, or the like) nor a photosensitizer component ($CeO_2$). Further, a commercially available glass may be also used. The above glasses show a very small etching rate in the etching with hydrofluoric acid as compared with a portion where a lithium metasilicate crystal is deposited, and they are not easily roughened in surface, so that they have excellent properties as a glass substrate.

Further, in the method (iii), the glass substrate is not required to have high chemical durability, while it is preferably consistent with the above photosensitive glass in heat expansion characteristic. For example, the above photosensitive glass which is not exposed to light may be used, there may be used a non-photosensitive glass having the same composition as that of the photosensitive glass except that it contains neither a photosensitive component nor a photosensitizer component, or a commercially available glass may be used.

There are several methods for bonding the photosensitive glass and the glass substrate to each other. For example, there can be employed a method in which the photosensitive glass and the glass substrate are bonded to each other by softening them under heat treatment, or a method in which the photosensitive glass and the glass substrate are bonded to each other with a low melting point glass.

When the bonding is carried out by heat treatment, the glass substrate may be bonded to the photosensitive glass before a latent image is formed by exposure, or the glass substrate may be bonded to the photosensitive glass at any step after a latent image is formed by exposure but before the etching treatment, e.g., after a latent image is formed by exposure or at a time of crystallizing the latent image. Further, the glass substrate may be bonded to the photosensitive glass which has been etching-treated after the formation of a latent image by exposure. The heat treatment for the bonding is carried out at a temperature equal to, or higher than, the glass transition temperature(s) of the photosensitive glass and the glass substrate.

As already discussed, when the glass substrate is bonded to the photosensitive glass before a latent image is formed by exposure, it is required to use, as a glass substrate, a glass having no photosensitivity.

Of the above methods, the method in which the photosensitive glass and the glass substrate are bonded to each other at a time of crystallizing the photosensitive glass is excellent, since the crystallization of the photosensitive glass and the bonding of the photosensitive glass and the glass substrate to each other can be carried out by a single heat treatment operation.

When the photosensitive glass and the glass substrate are bonded to each other with a low melting point glass, it is preferred in the above methods (i) and (ii) to use a glass which is not easily corroded in the subsequent etching treatment (whose etching rate is at least smaller than that of the photosensitive glass), which has heat expansion characteristic consistent with those of the photosensitive glass and the glass substrate used, and which is softened at a temperature at which the photosensitive glass and the glass substrate are not crystallized. In the above method (iii), it is preferred to use a glass which has heat expansion characteristic consistent with those of the photosensitive glass and the glass substrate used, and which is softened at a temperature at which the photosensitive glass and the glass substrate are not crystallized. When in the above methods (i) and (ii), there is used the above-described photosensitive glass containing 55 to 85% of $SiO_2$, 2 to 20% of $Al_2O_3$ and 5 to 15% of $Li_2O$ in which $SiO_2+Al_2O_3+Li_2O>85\%$ as fundamental components, containing at least one of 0.001 to 0.05% of Au, 0.001 to 0.5% of Ag and 0.001 to 1% of $Cu_2O$ as a photosensitive component and containing 0.001 to 0.2% of $CeO_2$ as a photosensitizer, the low melting point glass is required to have a sag temperature of 490° C. or below, a heat expansion coefficient of $75\sim100\times10^{-7}/°$ C. and an etching rate smaller than that of a crystallized portion of the photosensitive glass (preferably, smaller than that of a non-crystallized portion of the photosensitive glass).

Generally, for example, silicate glass containing a large amount of PbO is frequently used as a low melting point glass for sealing. Since, however, the above low melting point glass has poor durability against acids so that it is corroded at an etching time, and the bonding strength cannot be retained any longer. Therefore, the above glass can be used in the above method (iii), while the glass is difficult to use in the methods (i) and (ii).

In contrast, a glass containing 55 to 80% of $P_2O_5$, 1 to 13% of $Al_2O_3$, 12 to 25% of ZnO, 0 to 7% of $Li_2O$, 0 to 12% of PbO, 0 to 12% of CaO, 0 to 12% of BaO, 0 to 5% of $SiO_2$ and 0 to 5% of $B_2O_3$, the above percentages being based on weight, has high durability against acids (diluted hydrofluoric acid in particular), and does not show any decrease in bonding strength by etching. The above glass is therefore preferably used as a low melting point glass particularly in the methods (i) and (ii).

The components of the above low melting point glass will be described hereinafter.

$P_2O_5$ is an essential component for obtaining a glass having hydrofluoric acid durability and a low melting point, and it is a fundamental component of the above glass. When the $P_2O_5$ content is less than 55%, the hydrofluoric acid durability decreases. On the other hand, when it exceeds 80%, the sag temperature (Ts) is too high. The $P_2O_5$ content is therefore limited to 55 to 80%, and it is preferably 57 to 77%.

$Al_2O_3$ is a component for improving the glass in chemical durability. When the $Al_2O_3$ content is less than 1%, the above effect is nil. When its content exceeds 13%, the devitrification resistance decreases. The $Al_2O_3$ content is therefore limited to 1 to 13%, and it is preferably 2 to 11%.

ZnO is a component which has an effect on decreasing the sag temperature and decreasing the heat expansion coefficient (a). When the ZnO content is less than 12%, the sag temperature is too high. When it exceeds 25%, the hydrofluoric acid durability and the devitrification resistance decrease. The ZnO content is therefore limited to 12 to 25%, and it is preferably 14 to 23%.

$LiO_2$ is a component which has an effect on decreasing the sag temperature. When the $LiO_2$ content exceeds 7%, however, the heat expansion coefficient is too large, and the devitrification resistance also decreases. The $LiO_2$ content is therefore limited to 0 to 7%, and it is preferably 0 to 5%.

PbO is a component which has an effect on decreasing the sag temperature. When the PbO content exceeds 12%, however, the devitrification resistance decreases, and the heat expansion coefficient also increases. The PbO content is therefore limited to 0 to 12%, and it is preferably 0 to 10%.

CaO and BaO are components which improve the devitrification resistance. When the content of one of these exceed 12%, however, the hydrofluoric acid durability decreases. The content of each of CaO and BaO is therefore limited to 0 to 12%, and it is preferably 0 to 10%.

$SiO_2$ is a component which improves the chemical durability. When the $SiO_2$ content exceeds 5%, however, the sag temperature is too high. The $SiO_2$ content is therefore limited to 0 to 5%, and it is preferably 0 to 3%.

$B_2O_3$ is a component which improves the devitrification resistance. When the $B_2O_3$ content exceeds 5%, however, the sag temperature is too high. The $B_2O_3$ content is therefore limited to 0 to 5%, and it is preferably 0 to 3%.

Part of the above metal oxides may be replaced with metal fluoride.

The above low melting point glass may contain, at least one component selected from the group consisting of oxides such as $As_2O_3$, $Sb_2O_3$, $Na_2O$, $K_2O$, $TiO_2$, $Nb_2O_3$, $La_2O_3$, $Y_2O_3$, $Gd_2O_3$, $Ta_2O_5$, $ZrO_2$, MgO and SrO and fluorides of metals constituting those oxides, as an arbitrary component in an amount of 20% or less based on the glass for the adjustment of the glass transition temperature, the sag temperature and the heat expansion coefficient, the improvement of the hydrofluoric acid durability and the devitrification resistance and defoaming. The content of the above arbitrary component is preferably up to 10%.

The low melting point glass is obtained by properly selecting orthophosphoric acid, aluminum hydroxide, zinc oxide, lithium carbonate, lead oxide, calcium carbonate, barium nitrate, a silica powder, boric acid, and the like, weighing them such that batch materials have a desired glass composition, mixing the batch materials, placing the mixture in a heat-resistant crucible, melting the mixture under heat, stirring it to homogenize and defoam the mixture, shaping the mixture in a desired form, and gradually cooling the shaped product to room temperature.

For bonding the photosensitive glass and the glass substrate to each other with the low melting point glass, the photosensitive glass and the glass substrate may be bonded by slicing or cutting the low melting point glass and processing it in the form of a sheet, then sandwiching the sheet between the photosensitive glass and the glass substrate and heating the resultant set to a temperature equal to, or higher than, the sag temperature of the low melting point glass to soften and fuse the low melting point glass. Otherwise, the bonding may be carried out by pulverizing the low melting point glass to form a powder, applying the powder, for example in the form of a paste, onto the glass substrate (it is sufficient to apply the paste to a portion which is to form a spacer on the photosensitive glass in the above methods (i) and (ii)), then stacking the glass substrate on the photosensitive glass and heating the resultant set to soften and fuse the low melting point glass. Further, the bonding may be carried out by forming a thin film on the glass substrate, for example, by sputtering while using the low melting point glass as a target, stacking the glass substrate on the photosensitive glass and heating the resultant set to soften and fuse the low melting point glass. Moreover, there may be carried out a spot bonding in which a paste of the low melting point glass is screen-printed on a predetermined portion on the photosensitive glass or the glass substrate to form a low melting point glass spot, then, the photosensitive glass and the glass substrate are attached to each other and the resultant set is heated to soften and fuse the low melting point glass.

In the above methods (i) and (ii), a cathode [e.g., ITO (indium tin oxide) thin film pattern] may be formed on the surface of the photosensitive glass at any step before the etching treatment. Otherwise, a cathode (e.g., ITO thin film pattern) may be formed in advance on the glass substrate which is to be bonded to the photosensitive glass. And, when the photosensitive glass on which a cathode is formed or the glass substrate on which a cathode is formed is used, a spacered substrate provided with the cathode can be obtained when the spacer is formed by the etching treatment. The electrode can be formed by a conventional method such as a method of photolithography and the subsequent wet etching.

When the spacer in the form of a lattice is formed, a cathode prepared by coating metal aluminum on a phosphor is used as a cathode, and in this case, the metal aluminum should not adhere to the glass lattice. There is therefore employed a method in which the cathode is formed on the glass substrate in advance and the photosensitive glass in the form of a lattice is bonded thereto.

The spacered substrate for a self-emitting display, obtained by the process of the present invention, has the form of a pillar, a partition wall, a lattice, a honeycomb or the like, and the spacered substrate in any form is suitably used particularly for a field emission display. The spacered glass substrate in the form of a lattice or a partition wall can be also used for a plasma display.

In addition to the above process for the production of the spacered substrate for use in a self-emitting display, the present invention also provides a spacer for use in a self-emitting display, which is formed of the photosensitive glass, a spacered substrate for use in a self-emitting display, whose spacer is formed of the photosensitive glass, and a self-emitting display whose spacer is formed of the photosensitive glass.

The present invention will be explained more in detail with reference to Examples hereinafter, while the present invention shall not be limited by Examples.

EXAMPLE 1

Preparation Example of a pillar-shaped spacered substrate for use in a self-emitting display will be explained with reference to FIG. 2.

As a photosensitive glass, there was used a photosensitive glass plate which was formed of 79.5% of $SiO_2$, 4.0% of $Al_2O_3$, 10.2% of $Li_2O$, 4.0% of $K_2O$, 1.0% of $Na_2O$, 1.0% of ZnO, 0.4% of $Sb_2O_3$, 0.08% of Ag, 0.003% of Au and 0.01% of $CeO_2$, the percentages being based on weight, and which had a length of 100 mm, a width of 100 mm and a thickness of about 1 mm.

One main surface of a photosensitive glass 11 was brought into intimate contact with a glass mask 13 having a chromium film pattern 12 having a diameter of 100 $\mu$m, and was exposed to light from an ultraviolet irradiation lamp (not shown) at 1 kW for about 20 seconds, to form a latent image portion 14 corresponding to the exposed portion (see FIG. 1(*a*)).

Then, as a glass substrate 15, there was used a non-photosensitive glass plate which had the same composition ratio as the above photosensitive glass except that Ag and Au as photosensitive components and $CeO_2$ as a photosensitizer were not contained, and which had a length of 100 mm, a width of 100 mm and a thickness of about 1 mm. This glass substrate 15 and the photosensitive glass 11 on which the latent image was formed by exposure were attached to each other (see FIG. 2(*b*)).

Figure 2:
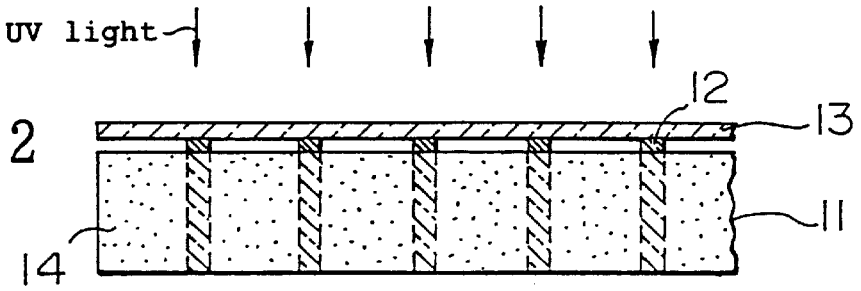
FIGS. 2(*a*) 2(*b*) 2(*c*) and 2(*d*) represent a series of production steps of a pillar-shaped spacered substrate for a self-emitting display in Example 1.
Figure 2:
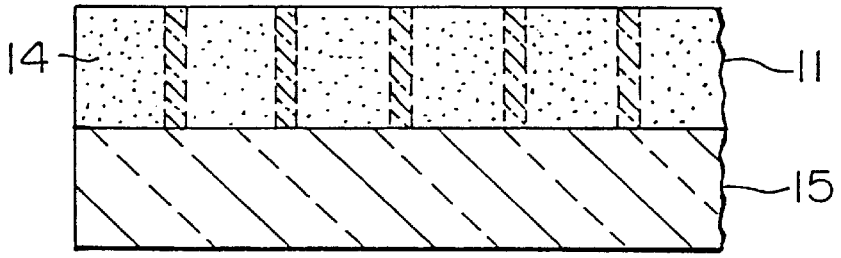
Figure 2:
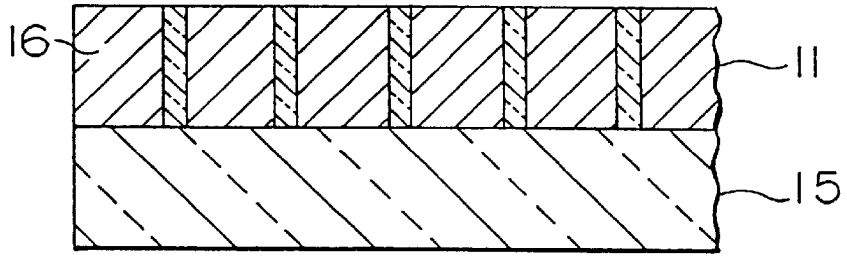
Figure 2:
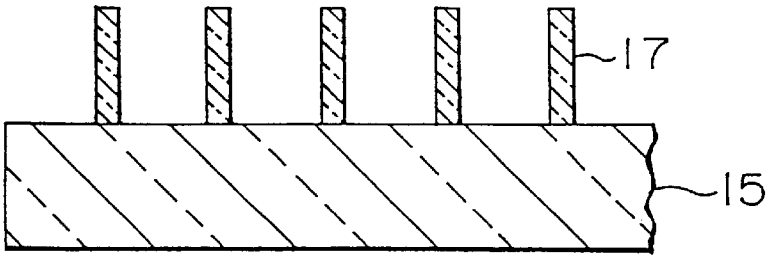

Then, the photosensitive glass 11 and the glass substrate 15 which were attached to each other were placed in a furnace for heat treatment, and heat-treated at a temperature of 550 to 600° C. while uniformly exerting a load of about 50 g/cm$^2$, to form a crystallized glass portion 16 by the crystallization of the latent image portion 14 of the photosensitive glass 11 and to bond the photosensitive glass 11 and the glass substrate 15 to each other (see FIG. 2(*c*)).

Then, the photosensitive glass 11 having the crystallized portion 16 and the glass substrate 15 which bonded to the photosensitive glass 11 were polished for the purpose of improving the flatness of each, and then, the set of these was etching-treated by immersing it in a bath of hydrofluoric acid having a concentration of 5% by weight for about 30 minutes, to remove the crystallized glass portion 16 of the photosensitive glass 11 by dissolving it. Thereafter, the set was withdrawn from the hydrofluoric acid bath and washed with water to give a glass substrate in which pillar-shaped spacer members 17 of the non-exposed non-crystallized portion were regularly arranged on the glass substrate 15

(see FIG. 2(*d*)). In the pillar-shaped spacered glass substrate, the glass substrate constitutes a behind panel of a self-emitting display.

Figure 6:
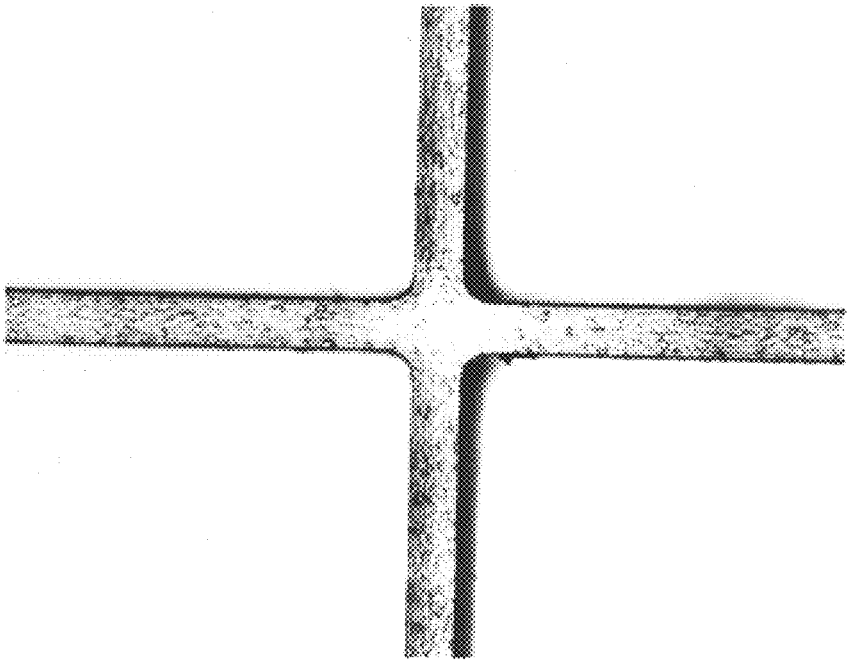
FIG. 6 is an electron microscopic photograph of a lattice-shaped spacered substrate for a self-emitting display obtained in Example 5, taken from above.

FIG. 6 shows an electron microscopic photograph (magnification×100) of the pillar-shaped spacered substrate obtained in this Example, taken in an oblique direction. In the Figure, black rod-like portions are the pillar-shaped spacer members, and a white ground is the glass substrate. FIG. 6 shows that, in the pillar-shaped spacered substrate, the spacer members has high accuracy and that no roughening was observed on the glass substrate surface.

EXAMPLE 2

A low melting point glass for bonding a photosensitive glass and a glass substrate to each other was prepared as follows.

Oxides, hydroxides, carbonates, nitrates, etc., such as $H_3PO_4$, $Al(OH)_2$, ZnO, $Li_2CO_3$, PbO, $CaCO_3$, $Ba(NO_3)$, etc., were used as required and were weighed such that batch materials had a glass composition shown in Table 1 and mixed, and the mixture was placed in a crucible of platinum and melted at 1,200 to 1400° C. for 1 to 2 hours. Then, the melt was stirred to homogenize and defoam the melt, and then a glass in a molten state was cast into a mold having predetermined form to shape it. Then, the shaped product was transferred into an electric furnace pre-heated to a temperature close to its glass transition temperature, and the product was gradually cooled in the furnace to room temperature to give a glass block. Table 1 shows the glass transition points, sag temperatures, heat expansion coefficients (average linear expansion coefficients at 100 to 300° C.) and hydrofluoric acid durability of the so-obtained low melting point glass blocks 1 to 7. In Table 1, glass transition point values, sag temperature values and heat expansion coefficients are values obtained by measurement with a thermomechanical analysis apparatus, and hydrofluoric acid durability values are values obtained by measuring a weight loss per unit surface area after polished low melting point glass samples were immersed in diluted hydrofluoric acid having a concentration of 5% by weight at 25° C. for 60 minutes.

As shown in Table 1, it was found that all the low melting point glass blocks 1 to 7 had a glass transition point of 350 to 450° C., a sag temperature of 400 to 500° C., a heat expansion coefficient of $75\sim100\times10^{-7}$/° C. and a hydrofluoric acid durability of less than 10 mg/cm$^2$. Table 2 shows heat expansion coefficients and hydrofluoric acid durabilities of the glass portion (non-crystallized portion) and the lithium metasilicate crystallized portion of the photosensitive glass used in this Example.

TABLE 1

| Low melting point glass No. | 1 | 2 | 3 | 4 | 5 | 6 | 7 |
|---|---|---|---|---|---|---|---|
| $P_2O_5$ | 57.0 | 77.0 | 66.0 | 66.0 | 69.0 | 68.0 | 68.0 |
| $Al_2O_3$ | 10.0 | 3.0 | 9.0 | 11.0 | 2.0 | 5.0 | 5.0 |
| ZnO | 23.0 | 20.0 | 20.0 | 14.0 | 14.0 | 22.0 | 22.0 |
| $Li_2O$ | 1.0 | 0.0 | 5.0 | 2.0 | 0.0 | 2.0 | 2.0 |
| PbO | 8.7 | 0.0 | 0.0 | 7.0 | 0.0 | 0.0 | 0.0 |
| CaO | 0.0 | 0.0 | 0.0 | 0.0 | 7.0 | 0.0 | 0.0 |
| BaO | 0.0 | 0.0 | 0.0 | 0.0 | 8.0 | 0.0 | 0.0 |
| Others | $Sb_2O_3$ 0.3 | | | | | $SiO_2$ 3.0 | $B_2O_3$ 3.0 |
| Glass transition point (° C.) | 415 | 398 | 403 | 430 | 432 | 379 | 383 |

TABLE 1-continued

| Low melting point glass No. | 1 | 2 | 3 | 4 | 5 | 6 | 7 |
|---|---|---|---|---|---|---|---|
| Sag temperature (° C.) | 460 | 455 | 449 | 475 | 484 | 427 | 437 |
| Heat expansion coefficient ($\times10^{-7}$/° C.) | 78 | 81 | 80 | 80 | 94 | 92 | 97 |
| Hydrofluoric acid durability (mg/cm$^2$) | 8.3 | 0.1 | 1.7 | 0.7 | 0.1 | 3.4 | 0.3 |

The unit of each component value in Table is wt %.

The glass transition point values, sag temperature values and heat expansion coefficients are values obtained by measurement with a thermomechanical analysis apparatus.

The hydrofluoric acid durability values are values obtained by measuring a weight loss per unit area after treatment in diluted hydrofluoric acid having a concentration 10 of 5% by weight at 25° C. for 60 minutes. (to be continued)

The unit of each component value in Table is wt %.

The glass transition point values, sag temperature values and heat expansion coefficients are values obtained by measurement with a thermomechanical analysis apparatus.

The hydrofluoric acid durability values are values obtained by measuring a weight loss per unit area after treatment in diluted hydrofluoric acid having a concentration of 5% by weight at 25° C. for 60 minutes.

TABLE 2

| | Photosensitive glass | |
|---|---|---|
| | Glass portion | Crystallized portion |
| Heat expansion coefficient ($\times10^{-7}$/° C.) | 84 | 84 |
| Hydrofluoric acid durability (mg/cm$^2$) | 2.5 | 75.8 |

When the heat expansion coefficients of the low melting point glass blocks 1 to 7 in Table 1 and the heat expansion coefficients of the photosensitive glass block in Table 2 are compared, the heat expansion coefficients of the low melting point glass blocks 1 to 7 in Table 1 are similar to those of the photosensitive glass blocks in Table 2. In particular, the low melting point glass block 2 in Table 1 had a heat expansion coefficient of $81\times10^{-7}$/° C., and this value among those heat expansion coefficients of the low melting point glass blocks was the closest to the heat expansion coefficient ($84\times10^{-7}$/° C.) of the photosensitive glass. As a low melting point glass for bonding a photosensitive glass and a glass substrate, this Example therefore used a 0.5 mm thick sheet obtained by slicing the glass block of the low melting point glass 2 and polishing the sliced sheet. Naturally, however, the low melting point glass blocks 1 and 3 to 5 in Table 1 can be used depending upon the heat expansion coefficient of a photosensitive glass.

For comparison, there was prepared a silicate glass containing a large amount of PbO, which is conventionally used as a sealing glass. Table 3 shows the composition of the silicate glass. The silicate glass was measured for a glass transition point, a sag temperature, a heat expansion coefficient and a hydrofluoric acid durability to show that, as shown in Table 3, the silicate glass had a hydrofluoric acid durability of over 24.2 mg/cm$^2$ or was easily corroded with hydrofluoric acid, so that the silicate glass could not be used for bonding a photosensitive glass and a glass substrate in this Example.

TABLE 3

| | Comparative Example |
|---|---|
| $SiO_2$ | 8.0 |
| $B_2O_3$ | 16.4 |
| $Al_2O_3$ | 1.0 |
| PbO | 54.6 |
| ZnO | 10.0 |
| $Bi_2O_3$ | 10.0 |
| Glass transition point (° C.) | 410 |
| Sag temperature (° C.) | 443 |
| Heat expansion coefficient ($\times 10^{-7}$/° C.) | 82 |
| Hydrofluoric acid durability (mg/cm$^2$) | >24.2 |

The production procedures for producing the spacered substrate for a self-emitting display in this Example will be explained with reference to FIG. 3 hereinafter.

As a photosensitive glass, there was used a photosensitive glass having the same composition and the same size as those of the photosensitive glass used in Example 1.

Figure 3:
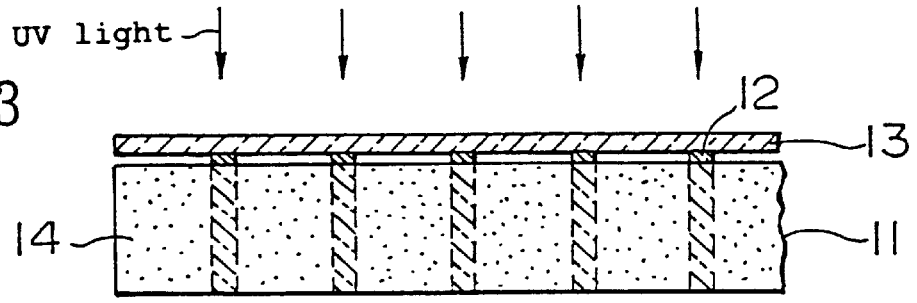
FIGS. 3(*a*) 3(*b*) 3(*c*) and 3(*d*) represent a series of production steps of a pillar-shaped spacered substrate for a self-emitting display in Example 2.
Figure 3:
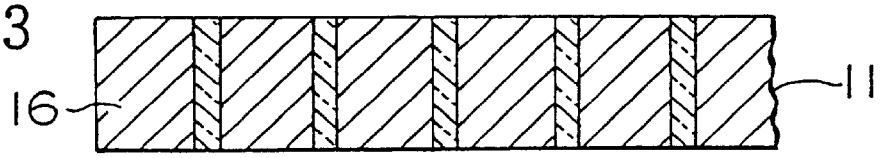
Figure 3:
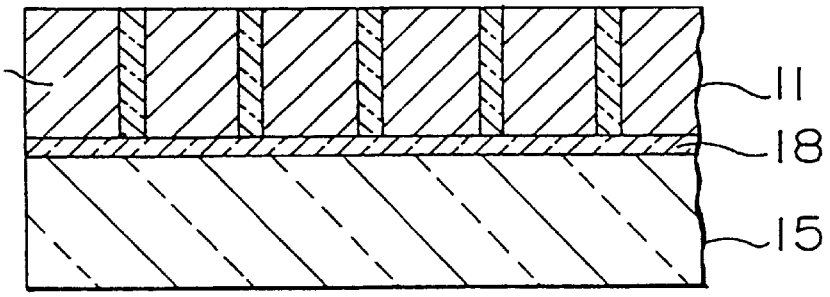
Figure 3:
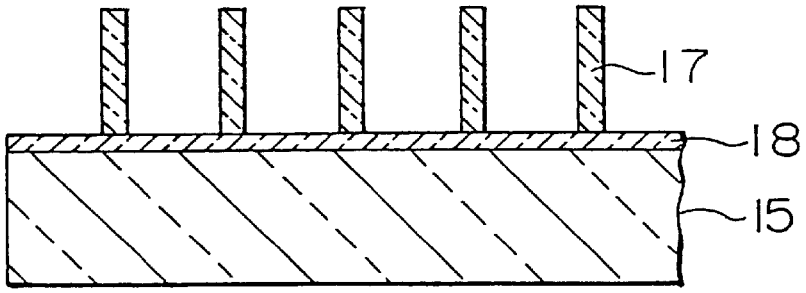

In the same manner as in Example, 1, one main surface of the photosensitive glass 11 was brought into intimate contact with a mask 13 of glass having a chromium film pattern 12 having a diameter of about 100 $\mu$m, and the resultant set was exposed to light with an ultraviolet irradiation lamp (not shown) at 1 kW for about 20 seconds, to form a latent image portion 14 corresponding to the exposed portion (see FIG. 3(*a*)).

The photosensitive glass 11 on which the latent image portion 14 was formed by exposure was heat-treated at 550 to 600° C. to crystallize the latent image portion 14, whereby a photosensitive glass having a crystallized portion 16 was obtained (see FIG. 3(*b*)).

Then, a low melting point glass sheet 18 formed of the low melting point glass 2 in Table 1 was sandwiched between the photosensitive glass 11 having the crystallized portion 16 and a glass substrate 15, and a set of these was heat-treated at a temperature of 500 to 600° C. while uniformly exerting a load of about 50 g/cm$^2$ to soften the low melting point glass 18 and to bond the photosensitive glass 11 and the glass substrate 15 with the low melting point glass 18 (see FIG. 3(*c*)).

Further, when a paste of the low melting point glass was spotwise printed on the crystallized glass portion of the photosensitive glass by a method such as a screen printing method, followed by heat treatment, the photosensitive glass and the glass substrate could be bonded to each other as well.

A laminate of the photosensitive glass 11 and the glass substrate 15 obtained by placing the low melting point glass 18 therebetween was polished to improve its flatness, and etching-treated by immersing it in a bath of hydrofluoric acid having a concentration of 5% by weight, to remove the crystallized glass portion 16 of the photosensitive glass 11 by dissolving it. Then, the laminate was withdrawn from the bath and washed with water to give a glass substrate in which pillar-shaped spacer members 17 formed of the non-exposed non-crystallized portion were regularly arranged on the low melting point glass 18 on the glass substrate 15 (see FIG. 3(*d*)).

Further, when a glass substrate provided with an ITO electrode in advance was used as a glass substrate to be bonded to the photosensitive glass, there could be obtained a pillar-shaped spacered substrate provided with an ITO electrode as well.

Like the product obtained in Example 1, the spacer of the pillar-shaped spacered glass substrate obtained in this Example had high accuracy and no roughening was observed on the glass substrate surface.

EXAMPLE 3

This Example is concerned with a process for the production of a pillar-shaped spacered substrate in which a cathode is also formed.

The procedures for producing the pillar-shaped spacered substrate for a self-emitting display, according to the present invention, will be explained with reference to FIGS. 4 and 5 hereinafter.

As a photosensitive glass, there was used a photosensitive glass having the same composition and the same size as those of the photosensitive glass used in Example 1.

Figure 4:
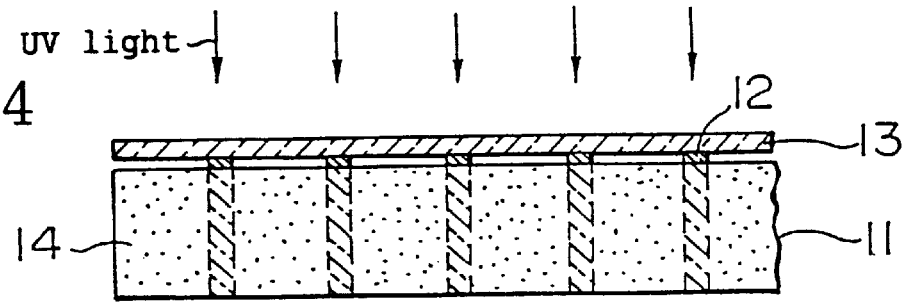
FIGS. 4(*a*) 4(*b*) 4(*c*) 4(*d*) 4(*e*) 4(*f*) and 4(*g*) represent a series of the production steps of a pillar-shaped spacered substrate for a self-emitting display in Example 3.
Figure 4:
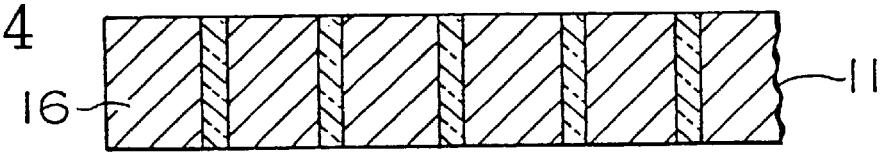
Figure 4:
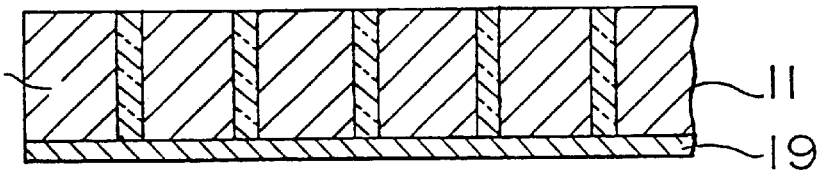
Figure 4:
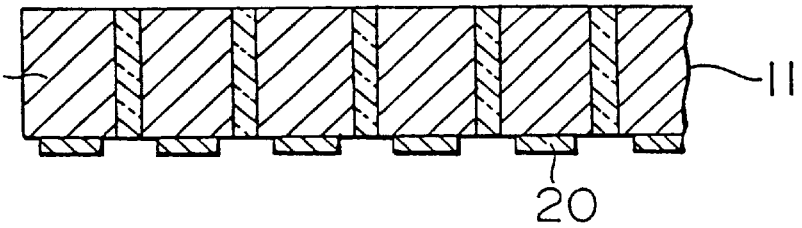
Figure 4:
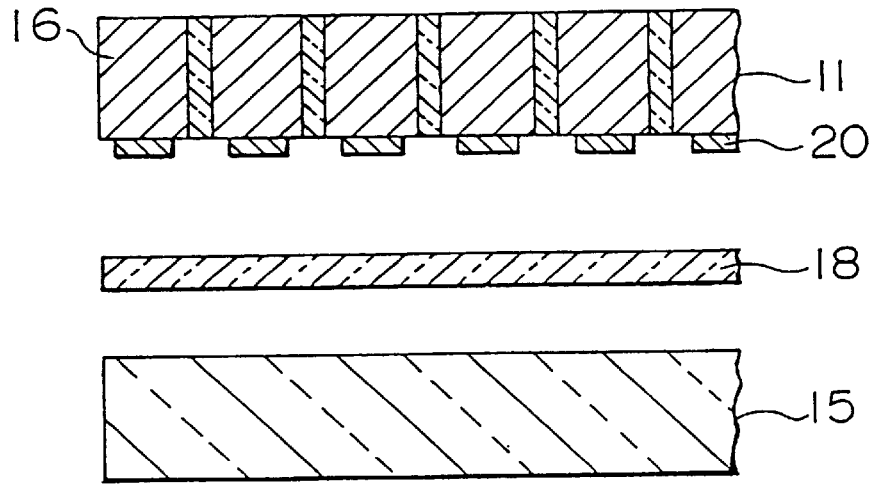
Figure 4:
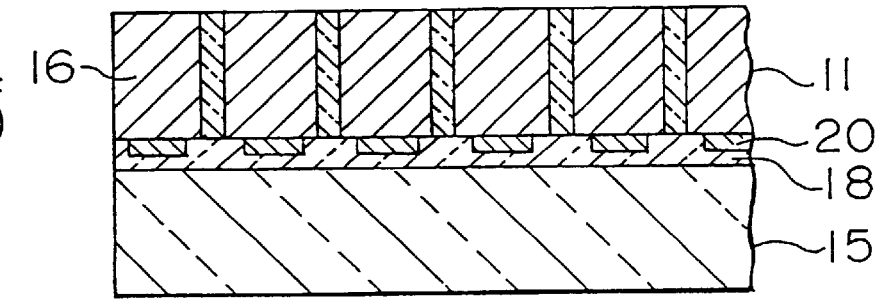
Figure 4:
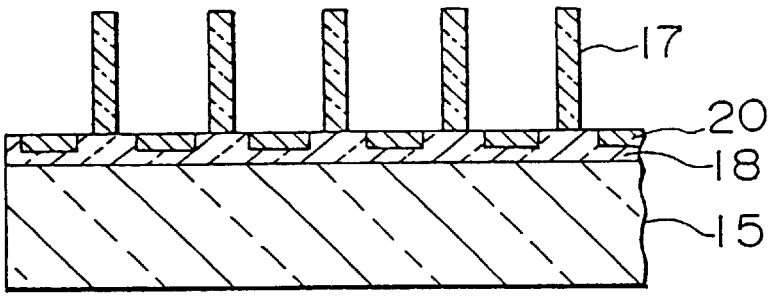
Figure 5:
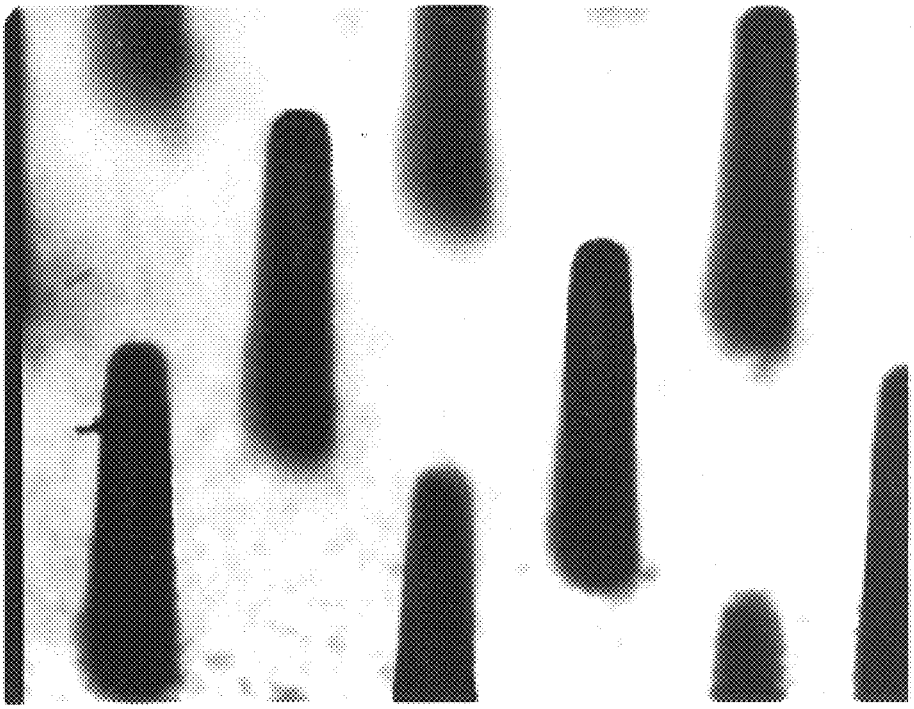
FIG. 5 is an electron microscopic photograph of the pillar-shaped spacered substrate for a self-emitting display obtained in Example 1, taken in an oblique direction.

In the same manner as in Example 1, one main surface of the photosensitive glass 11 was brought into intimate contact with a mask 13 of glass having a chromium film pattern 12 having a diameter of about 100 $\mu$m, and the resultant set as exposed to light with an ultraviolet irradiation lamp (not shown) at 1 kW for about 20 seconds, to form a latent image portion 14 corresponding to the exposed portion (see FIG. 4(*a*)).

The photosensitive glass 11 on which the latent image portion 14 was formed by exposure was heat-treated at 550 to 600° C. to crystallize the latent image portion 14, whereby a photosensitive glass having a crystallized portion 16 was obtained (see FIG. 4(*b*)).

Then, a 0.2 $\mu$m thick thin film 19 of ITO (indium· tin oxide) as a cathode material was formed on the photosensitive glass 11 having the crystallized portion 16 (see FIG. 4(*c*)).

Then, the above ITO thin film was patterned by photolithography and wet etching (using a hydrochloric acid-containing etchant), to form an ITO electrode 20 (see FIG. 4(*d*)).

Then, a low melting point glass 18 which was the same as that used in the above Example 2 was sandwiched between the photosensitive glass 11 having the ITO electrode 20 formed and a glass substrate 15 (see FIG. 4(*e*)).

Then, the photosensitive glass 11, the low melting point glass 18 and the glass substrate 15 were stacked, and the resultant set was heat-treated at a temperature of 500 to 600° C. while uniformly applying a load of about 50 g/cm$^2$ in the above stacked state to soften the low melting point glass 18 and to bond the photosensitive glass 11 and the glass substrate 15 with the low melting point glass 18 (see FIG. 4(*f*)).

The resultant three-layered laminate of the photosensitive glass 11, the low melting point glass 18 and the glass substrate 15 was polished to improve its flatness and etching-treated by immersing it in a bath of hydrofluoric acid having a concentration of 5% by weight for about 30 minutes, to remove the crystallized glass portion 16 of the photosensitive glass 11 by dissolving it. Then, the laminate was withdrawn from the hydrofluoric acid bath and washed with water to give a glass substrate in which pillar-shaped spacer members 17 formed of the non-exposed non-crystallized portion were regularly arranged on the low melting point glass 18 on the glass substrate 15 (see FIG. 4(*g*)). This spacered glass substrate was provided with an ITO electrode 20.

Like the product obtained in Example 1, the spacer of the pillar-shaped spacered glass substrate obtained in this Example had high accuracy and no roughening was observed on the glass substrate surface.

EXAMPLE 4

A latent image was formed by exposure in the same manner as in Example 2 except that a portion to form a spacer on a photosensitive glass was masked by screen-printing a paste of opacified low melting point glass obtained by adding an opacifier (cerium oxide or titanium oxide) to a low melting point glass, in place of using the glass mask having a chromium film pattern formed on a glass sheet.

Then, the photosensitive glass to which the opacified low melting point glass adhered was heat-treated in the same manner as in Example 2 to crystallize the photosensitive glass.

Then, the photosensitive glass having a crystallized portion and a glass substrate were stacked such that the opacified low melting point glass was sandwiched therebetween, and the resultant set was heat-treated to bond the photosensitive glass and the glass substrate to each other.

Then, the laminate of the photosensitive glass and the glass substrate was etching-treated to remove the crystallized portion of the photosensitive glass by dissolving it, whereby a pillar-shaped spacered substrate was obtained.

Further, when a glass substrate provided with an ITO electrode in advance was used as a glass substrate to be bonded to the photosensitive glass, there could be obtained a spacered substrate provided with an ITO electrode as well.

Like the product obtained in Example 1, the spacer of the pillar-shaped spacered glass substrate obtained in this Example had high accuracy and no roughening was observed on the glass substrate surface.

EXAMPLE 5

AS a photosensitive glass, there was used a photosensitive glass having the same composition and the same size as those in Example 1.

In the same manner as in Example 1, one main surface of the photosensitive glass was brought into intimate contact with a glass mask having a lattice-shaped pattern which was formed of a chromium film and had a line width of about 70 $\mu$m, and the photosensitive glass was exposed to light with an ultraviolet irradiation lamp at 1 kW for about 20 seconds, to form a latent image portion corresponding to the exposed portion.

The photosensitive glass on which the latent image portion was formed by exposure was heat-treated at a temperature of 550 to 600° C. to crystallize the latent image portion, whereby a photosensitive glass having the crystallized portion was obtained.

Then, the photosensitive glass having the crystallized portion was polished to improve its flatness, and then etching-treated by immersing it on a bath of hydrofluoric acid having a concentration of 5% by weight for about 30 minutes, to remove the crystallized portion of the photosensitive glass by dissolving it. The photosensitive glass was withdrawn from the hydrofluoric acid bath and washed with water to give a lattice-shaped spacer formed of a non-exposed non-crystallized portion.

On the other hand, as a glass substrate, there was used a non-photosensitive substrate having the same composition and the same size as those in Example 1. A paste of low melting point glass having a glass composition shown in Table 3 was screen-printed on the glass substrate to form low melting point glass spots, and then, the above lattice-shaped spacer of the photosensitive glass and the glass substrate were attached to each other. Then, the resultant set of the lattice-shaped spacer of the photosensitive glass and the glass substrate was placed in a heat-treatment furnace, heat-treated at a temperature of 500 to 600° C. to soften the low melting point glass and to bond the lattice-shaped spacer of the photosensitive glass and the glass substrate to each other, whereby a lattice-shaped spacered glass substrate was prepared.

FIG. 6 shows an electron microscopic photograph (magnification×100) of the lattice-shaped spacered substrate obtained in this Example. FIG. 6 shows that the lattice·partition wall of the lattice-shaped spacered substrate had high accuracy.

Effects of the Invention

According to the present invention, there is provided a process for the production of a spacered substrate for use in a self-emitting display, which is advantageous in that the spacer has high accuracy and high heat resistance, the roughening of the substrate surface is not easily caused, the production procedures are simple and the production cost is inexpensive. The spacered substrate obtained by the process of the present invention is suitably used in a field emission display.

What is claimed is:

1. A process for the production of a spacered substrate for use in a self-emitting display, which comprises the steps of:

(1) exposing a photosensitive glass to light while masking a portion to form a spacer on a surface of the photosensitive glass thereby forming a latent image corresponding to an exposed portion, (2) crystallizing the exposed portion having the latent image, and (3) etching and removing a crystallized exposed portion and thereby forming a spacer of non-exposed photosensitive glass on a glass substrate, whereby the photosensitive glass and the glass substrate are bonded to each other by stacking the photosensitive glass and the glass substrate directly one on the other and heat-treating the resultant stack.

2. A process for the production of a spacered substrate for use in a self-emitting display, which comprises the steps the successive steps of:

(1) bonding the photosensitive glass and the glass substrate to each other by stacking the photosensitive glass and the glass substrate directly one on the other and heat-treating the resultant stack, (2) exposing a photosensitive glass to light while masking a portion to form a spacer on a surface of the photosensitive glass thereby forming a latent image corresponding to an exposed portion, (3) crystallizing the exposed portion having the latent image, and (4) etching and removing a crystallized exposed portion and thereby forming a spacer of non-exposed photosensitive glass on a glass substrate.

3. The process of claim 1 or 2, wherein the photosensitive glass is a photosensitive glass containing 55 to 85% of $SiO_2$, 2 to 20% of $Al_2O_3$ and 5 to 15% of $Li_2O$ in which $SiO_2+Al_2O_3+Li_2O>85\%$ as fundamental components, containing at least one of 0.001 to 0.05% of Au, 0.001 to 0.5% of Ag and 0.001 to 1% of $Cu_2O$ as a photosensitive component and containing 0.001 to 0.2% of $CeO_2$ as a photosensitizer, all percentages being based on weight.

4. The process of claim 1, wherein the photosensitive glass is bonded to the glass substrate in advance before the latent image is formed on the photosensitive glass by exposure.

5. The process of claim 1 or 2, wherein the photosensitive glass is bonded to the glass substrate at any step after the latent image is formed by exposure and before the etching treatment is carried out.

6. The process of claim 1 or 2, wherein the photosensitive glass obtained by the etching treatment after the latent image was formed by exposure is bonded to the glass substrate.

7. The process of claim 1 or 2, wherein the low melting point glass contains 55 to 80% of $P_2O_5$, 1 to 13% of $Al_2O_3$, 12 to 25% of ZnO, 0 to 7% of $Li_2O$, 0 to 12% of PbO, 0 to 12% of CaO, 0 to 12% of BaO, 0 to 5% of $SiO_2$ and 0 to 5% of $B_2O_3$, the above percentages being based on weight.

8. The process of claim 1 or 2, wherein a cathode is formed on the photosensitive glass in advance at any step before the etching treatment is carried out.

9. The process of claim 1 or 2, wherein the spacer has the form of a pillar, a partition wall, a lattice or a honeycomb.

10. The process of claim 1 or 2, wherein the self-emitting display is a field emission display.

* * * * *